US006024244A

United States Patent [19]

Hicks

[11] Patent Number: 6,024,244

[45] Date of Patent: Feb. 15, 2000

[54] CONTAINER SAFETY ATTACHMENT AND STABILIZING COLLAR

[76] Inventor: Joshua Hicks, 175 Pearl St., Holyoke, Mass. 01040

[21] Appl. No.: 09/183,792

[22] Filed: Oct. 30, 1998

[51] Int. Cl.[7] ..... B65D 41/00

[52] U.S. Cl. ..... 220/603; 215/376

[58] Field of Search ..... 220/603, 630, 220/636, 729, 730; 215/376

[56] References Cited

U.S. PATENT DOCUMENTS

| | | | |
|---|---|---|---|
| 434,423 | 8/1890 | Burrows | 220/603 |
| 3,229,949 | 1/1966 | Chaconas | 215/376 X |
| 4,241,839 | 12/1980 | Alberghini | 215/376 |
| 4,573,604 | 3/1986 | Guim | 215/376 X |
| 4,905,945 | 3/1990 | Peterson | 220/603 X |
| 5,295,598 | 3/1994 | Gerlach et al. | 215/376 |

*Primary Examiner*—Steven Pollard
*Attorney, Agent, or Firm*—James F. Baird

[57] ABSTRACT

A convex shaped apparatus transversed with a flat base at the bottom, sized and shaped to be fixedly attached to the base of a standard container. The apparatus may either be hollow (with the top open) to act together with the standard container to hold the contents or separately fixedly attached to the bottom of the standard container. The weight of the apparatus is sufficient to lower the center of gravity of the combined apparatus and standard container no matter whether the container is full, partially full or empty. The convex shaped surface of the apparatus, above the flat base of the apparatus, insures that the container is unstable when left unattended. In the event that the container fills with liquid such as rain water, it wall tip on its side if a curious child investigates and tries to get in the container. The tipping container allows the liquid to spill out rendering the container harmnless to a child and prevents the drowning of the child. When the container is in storage, being shipped or in normal use, a removable collar sized and shaped to fit around the lower base of the standard container and the convex shaped apparatus. The removable collar and convex shaped apparatus with the flat base act together to provide stability and prevent the apparatus and container from tipping.

2 Claims, 3 Drawing Sheets

CONTAINER SAFETY ATTACHMENT AND STABILIZING COLLAR

BACKGROUND OF THE INVENTION

For years products have been delivered in containers for use by the consumer or worker. An example is the five gallon container used to ship various products such as foodstuff and contractors materials. These containers are used to store the product while being used and frequently for other items after the original product is used up. For example at most construction sites several five gallon containers are present holding sheetrock seam or joint compound. As the joint compound is used the containers are gradually emptied. Once empty the containers are convenient storage areas at the construction site or at home for other items. Some of the containers are filled with various liquids and some are left without any cover. The uncovered containers are a particular problem as liquid or rain water may collect therein. In the event a curious child looks into one of these uncovered containers it is possible that he or she could loose his or her balance and fall head first into the container. Many incidents of this nature occur each year with tragic results.

It is now a common practice for the containers that are placed in commerce to have a warning label for example:

WARNING

CHILDREN CAN FALL INTO BUCKET

AND DROWN. KEEP CHILDREN

AWAY FROM BUCKET WITH EVEN

A SMALL AMOUNT OF LIQUID

One of the objects of my invention is to provide an apparatus that makes the container unstable when not in use.

A further object of the invention is to provide an additional apparatus, used in conjunction with the first apparatus, to provide stability when the container is in use to prevent tipping.

An additional object of the invention is to provide a useful container that is an improvement to the conventional container making it both safe and practical.

With these and other objects in view, as will be apparent to those skilled in the art, the invention resides in the combination of parts set forth in the specification and covered by the claims appended hereto.

SUMMARY OF THE INVENTION

The apparatus disclosed in detail below is of a form that is both practical and economical to manufacture in order to promote wide use. In addition to its preferred form, it may be formed together with the container as a single unit. In addition to being hollow it may be solid or partially filled with material to create the required weight.

The invention is a weighted convex container safety attachment and a removable stabilizing collar. The weighted convex container safety attachment is a convex shaped member transversed with a flat base at the bottom, sized and shaped to be fixedly attached to the base of a standard container. The weight of the member when attached to the container acts, together with the weight of the container, to change the location of the center of gravity of the container alone, to a location that is closer to, or below, the bottom of the container when the container is attached to and combined with the member. The reason for this result is that the member has a weight that is significant in relation to the weight of the empty container. The weight of the member is large enough to cause this result no matter whether the container is full, partially full or empty. The flat base of the member has a diameter that is small in relation to the diameter of the container. The small diameter base together with the convex shaped surface of the member insures that the container is unstable when left unattended. In the event the container fills with liquid such as rain water, it will tip on its side if a curious child investigates and tries to look in or get into the container. The tipping container allows the liquid to spill out rendering the container harmless to the child, avoiding the possible of the child. When the container is in normal use a removable stabilizing collar, sized and shaped to fit around both the lower side of the container and the weighted convex container safety attachment, may be utilized to provide stability and prevent the container from tipping.

The flat base of the weighted convex container safety attachment cuts horizontally through the convex surface of the member to form a flat disk at and for the bottom of the member; this member is all one piece. The dimensions of the convex surface and the flat base disk of the weighted convex container safety attachment are determined by the size and weight of the container being used. The dimensions of the removable stabilizing collar are determined by the size and weight of the container being use and the size and weight of the weighted convex container safety attachment.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF THE DRAWINGS

The object and features of the invention may be understood with reference to the following detailed description of an illustrative embodiment of the invention, taken together with the accompanying drawings in which.

DESCRIPTION OF THE PREFERRED EMBODIMENT

Figure 1:
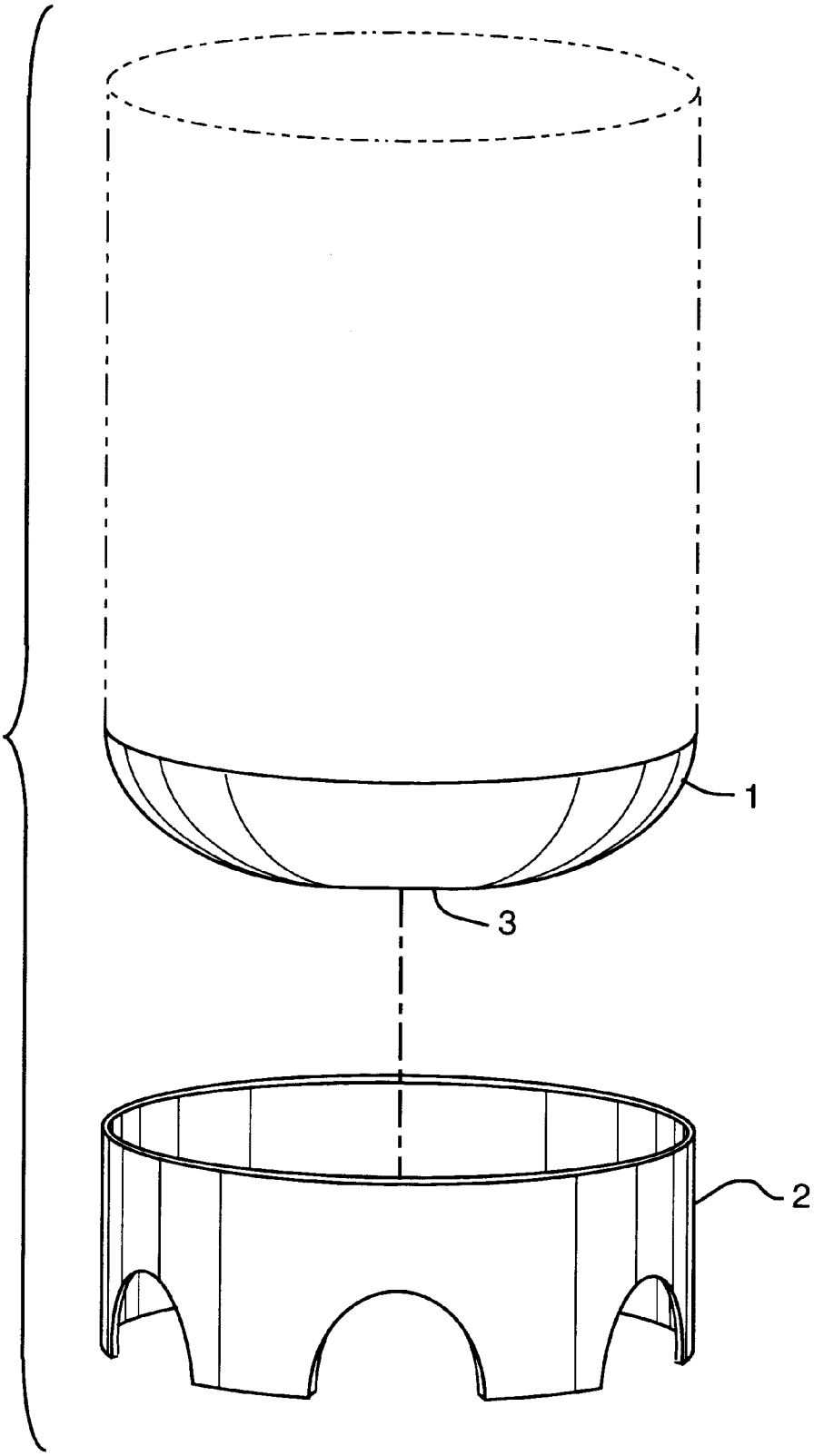
FIG. 1 shows the present invention, the Container Safety Attachment and Stabilizing Collar. The Weighted Convex Container Safety Attachment 1, and Removable Stabilizing Collar 2, are shown in a separated position. Shown is the flat base 3. A container is shown in dotted lines for illustration only.

Turning first to FIG. 1 there is shown the present invention, The Container Safety Attachment and Stabilizing Collar. The Weighted Convex Container Safety Attachment 1 and Removable Stabilizing Collar 2 are shown. As can be seen the Weighted Convex Container Safety Attachment 1 is a converse convex shaped member transversed with a flat base 3, at the bottom, sized and shaped to be fixedly attached to the base of a standard container (shown in dotted lines).

Figure 2:
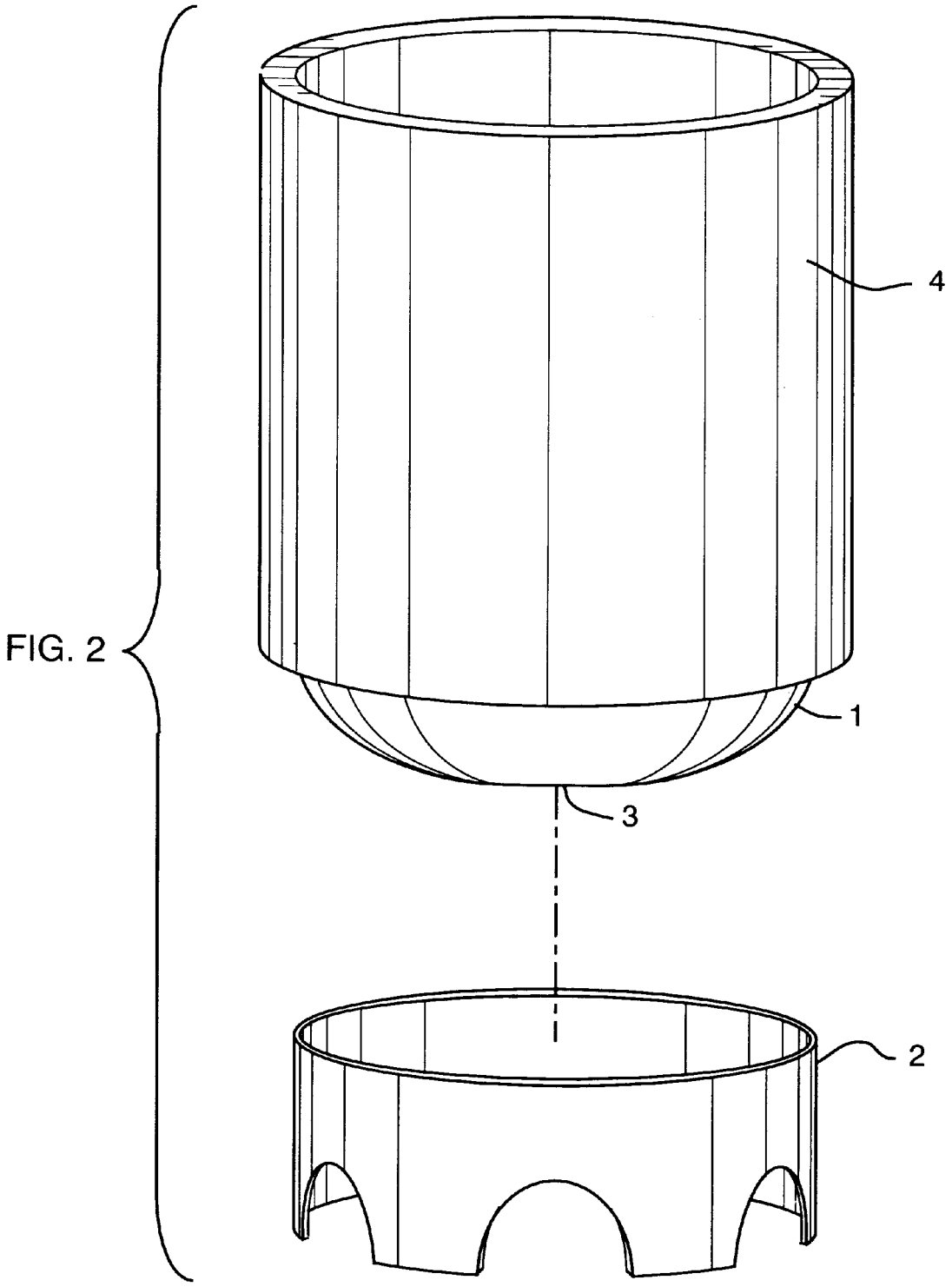
FIG. 2 shows a second configuration where the Weighted Convex Container Safety Attachment 1 is formed as a unit with the container to form a single member 4. There is shown the flat base 3. Once again the Removable Stabilizing Collar 2, is shown in a separated position.
Figure 3:
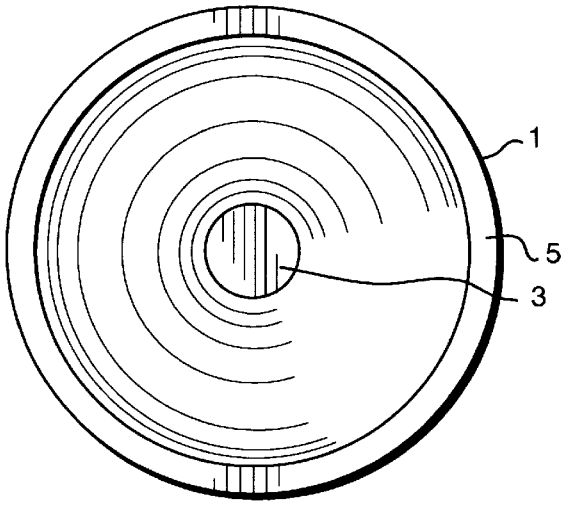
FIG. 3 shows a top view of The Weighted Convex Container Safety Attachment 1. The flat base 3 is shown. In addition a lip 5 is shown. This embodiment is for use when secured to The base of a container, where The container rests on The lip 5.
Figure 4:
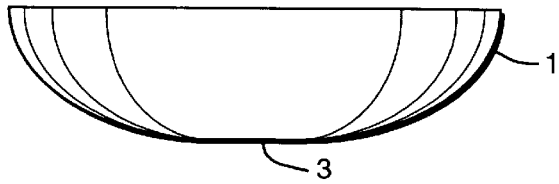
FIG. 4 shows a side view of The The Weighted Convex Container Safety Attachment 1.
Figure 5:
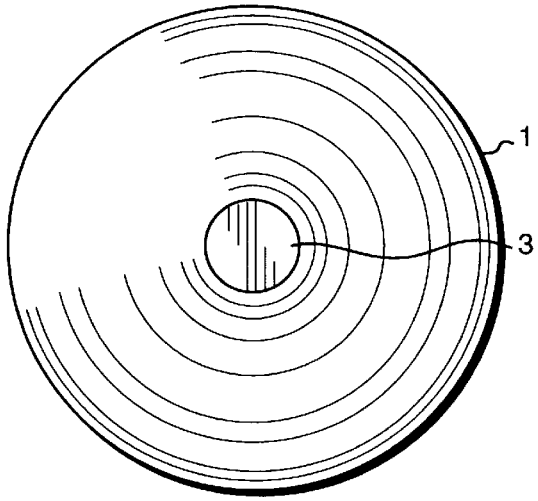
FIG. 5 shows a bottom view of The The Weighted Convex Container Safety Attachment 1.
Figure 6:
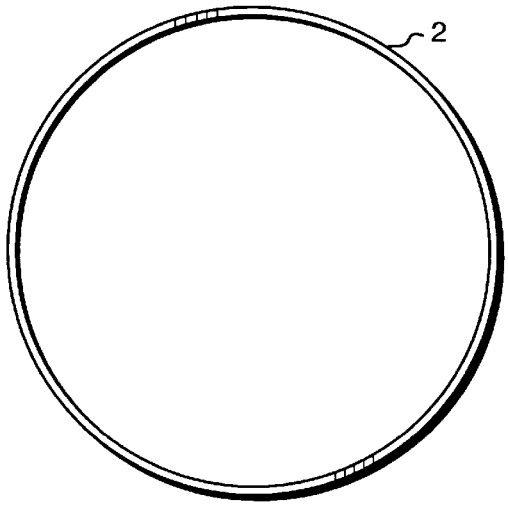
FIG. 6 shows a top view of The The Removable Stabilizing Collar 2.

The member may either be hollow (with the top open), to hold the contents of the container, where the member acts as the bottom of the container, as shown in FIG. 2, or separately fixedly attached to a standard container, as shown, as shown in FIG. 1. The weight of the member is sufficient to lower the center of gravity of the container no matter whether the container is full, partially fuill or empty. The converse convex shaped surface, above the flat base 3 of the member, insures that the container is unstable when left unattended. In the event that the container fills with liquid such as rain water, it will tip on its side if a curious child investigates and tries to get in the container. The tipping container allows the liquid to spill out rendering the container harmless to a child and prevents the drowning of the child. When the container is in storage, being shipped or in normal use, a Removable Stabilizing Collar 2, sized and shaped to fit around the lower portion of the container and the Weighted Convex Container Safety Attachment 1, with the flat base 3, may be utilized to provide stability and prevent the container from tipping.

The flat base of the container safety attachment cuts horizontally through the convex surface of the apparatus to form a flat disk at and for the bottom of the apparatus; this apparatus is all one piece. The dimensions of the convex surface and the flat base 3, of the Weighted Convex Safety Attachment 1 are determined by the size and weight of the container being used. The dimensions of the Removable Stabilizing Collar 2 are determined by the size and weight of the container being use and the size and weight of the Weighted Convex Safety Attachment 1.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I claim the following:

1. A container safety attachment and collar, for use with a container having a cylindical shape with a fixed diameter, a top open end, vertical cylindrical side and a flat closed bottom, comprising:

a) a weighted convex container safety attachment being formed in the shape of a bowl, having a top edge forming a circle with a fixed diameter identical to the fixed diameter of said container, a flat bottom having circular shape with a diameter smaller than the fixed diameter of said container and converse convex sides expanding in diameter from the weighted convex container safety attachment flat bottom to the weighted convex container safety attachment top edge, said safety attachment forming the lowermost portion of said container when attached thereto and rendering said container unstable; and b) a removable stabilizing collar being cylindrical in shape with a diameter slightly greater than the fixed diameter of said container to permit the removable stabilizing collar to be frictionally engaged with said container and said weighted convex container safety attachment top edge and rendering said container stable when attached thereto.

2. A container safety attachment and collar, for use with a container comprising:

a) a weighted convex container safety attachment being formed in the shape of a cylinder with a fixed diameter, a top open end, vertical cylindrical side and a bowl shaped closed bottom, said bowl shaped closed bottom having a flat bottom surface, and converse convex sides said bowl shaped closed bottom flat bottom surface having a circular shape with a diameter smaller than the fixed diameter of said weighted convex container safety attachment said converse convex sides expanding in diameter from the weighted convex container safety attachment bowl shaped closed bottom flat bottom surface to the weighted convex container safety attachment vertical cylindrical side, said safety attachment forming the lowermost portion of a container when attached thereto and rendering the container unstable; and b) a removable stabilizing collar being cylindrical in shape with a diameter slightly greater than the fixed diameter of said weighted convex container safety attachment to permit the removable stabilizing collar to be frictionally engaged with said weighted convex container safety attachment and rendering the container stable when attached thereto.

* * * * *